US006990876B2

(12) United States Patent
Mardian

(10) Patent No.: US 6,990,876 B2
(45) Date of Patent: Jan. 31, 2006

(54) POWER TONGS

(76) Inventor: Larry Mardian, Box 1822, Kindersley, Saskatchawan (CA) S0L 1S0

( * ) Notice: Subject to any disclaimer, the term of this patent is extended or adjusted under 35 U.S.C. 154(b) by 254 days.

(21) Appl. No.: 10/440,471

(22) Filed: May 19, 2003

(65) Prior Publication Data

US 2005/0011312 A1 Jan. 20, 2005

(51) Int. Cl.
*B25B 13/50* (2006.01)

(52) U.S. Cl. ..... 81/57.18; 81/57.2; 81/57.33

(58) Field of Classification Search ..... 81/57.18, 81/57.15, 57.2, 57.21, 57.33
See application file for complete search history.

(56) References Cited

U.S. PATENT DOCUMENTS 3,023,651 A * 3/1962 Wallace ..... 81/57.18
4,290,304 A * 9/1981 Eckel ..... 73/862.25
4,346,629 A 8/1982 Kinzbach
4,401,000 A * 8/1983 Kinzbach ..... 81/57.2
RE31,699 E * 10/1984 Eckel ..... 73/862.25
4,986,146 A * 1/1991 Buck ..... 81/57.18
5,048,377 A 9/1991 Varis
5,394,774 A * 3/1995 Dlask ..... 81/57.18
6,070,500 A 6/2000 Dlask
6,082,224 A * 7/2000 McDaniels et al. ..... 81/57.15
6,223,629 B1 * 5/2001 Bangert ..... 81/57.15
6,327,938 B1 * 12/2001 Pietras ..... 81/57.33
6,446,524 B1 * 9/2002 Gravouia ..... 74/459.5
6,619,160 B1 * 9/2003 Buck et al. ..... 810/57.18

* cited by examiner

*Primary Examiner*—David B. Thomas
(74) *Attorney, Agent, or Firm*—Nixon & Vanderhye P.C.

(57) ABSTRACT

A power tong apparatus for rotating a pipe comprises a tong housing and a ring gear, rotatably mounted in the tong housing. A top cage plate is positioned above an inner portion of the ring gear and a corresponding bottom cage plate is positioned below the inner portion of the ring gear. The cage plates form a cage rotatable with respect to the tong housing and the ring gear. A jaw is pivotally attached to the cage and grips the pipe when the ring gear is rotated with respect to the cage. The cage plates are fastened together by a fastener extending through a slot in the ring gear located between the inner and outer peripheries of the ring gear, such that the cage plates can rotate with respect to the ring gear through a limited arc.

14 Claims, 3 Drawing Sheets

POWER TONGS

This invention is in the field of power tongs for rotating pipe in well drilling and servicing operations, and in particular such tongs for rotating pipe having a variety of diameters.

BACKGROUND

Power tongs are common in well drilling operations for rotating cylindrical drill pipe, casing and the like to thread lengths together. Such tongs can have a closed throat, such that the pipe must enter the tongs through the hole in the middle, or can have an open throat, allowing the pipe to enter the tongs from the side.

Both types of tongs typically include top and bottom tong plates that are fastened together to form a tong housing with a central housing aperture. An open throat may lead to the central housing aperture, and typically a door will be provided to close the throat on the housing. A drive mechanism is mounted in the tong housing and rotates a ring gear. In open throat tongs, where the ring gear has an open throat leading to a central ring aperture, the drive typically comprises a drive motor rotating a pair of substantially horizontal drive gears that engage and rotate the ring gear. The drive gears are arranged so that one is engaging and rotating the ring gear while the open throat rotates past the other. In both open and closed throat tongs, the ring gear is typically held in position during rotation by rollers rotatably fastened between the top and bottom tong plates and bearing against the outer periphery of the ring gear teeth.

A pivoting jaw mechanism is mounted on a cage which rotates with respect to the tong housing to move the jaws into gripping engagement with the pipe. The cage typically comprises top and bottom cage plates located above and below the ring gear and defining a central cage aperture in the middle. The cage may have an open throat leading to the central cage aperture.

In closed throat type power tongs, an end of the pipe is moved through the central aperture and then the pipe moves up and down in the aperture as joints are threaded together or taken apart.

Open throat tongs are moved into position by aligning the open throats on the tong housing, ring gear, and cage and passing the pipe through the aligned open throats into the central aperture. Typically a door closes the open throat on the tong housing to prevent the pipe from accidentally escaping from the tongs.

In either type tongs, when the drive begins to rotate the ring gear, the cage rotates through several degrees with respect to the ring gear and the jaws move into gripping engagement with the pipe. Once the jaws are engaged, the cage and ring gear then rotate together, with respect to the tong housing.

In a typical set of power tongs, each of a pair of jaws is pivotally mounted by a bolt to the top and bottom cage plates. A jaw roller attached to the jaw rests in a valley on the inner periphery of the ring gear when the jaws are in an open position. When the ring gear is rotated by the drive gears, the cage remains substantially stationary, commonly held by the friction of a brake, and the jaw roller thus moves out of the valley and up a slope on the inner periphery of the ring gear and pivots the jaw into engagement with the pipe, at which point the cage and ring gear rotate together with the jaws gripping and rotating the pipe as well. The friction of the brake is overcome by the force of the rotating ring gear engaging the jaws and thus the cage. Reversing the direction of rotation of the ring gear releases the jaws and further reverse rotation will cause the jaws to re-grip the pipe and rotate same in the reverse direction.

The orientation of the parts to allow the required movements relative to each other conventionally requires that cage bolts and spacers, or equivalent fasteners, holding the top and bottom cage plates together pass through the aperture inside the inner periphery of the ring gear. Commonly different sets of jaws are provided for a tong assembly to allow for use on pipes with a range of diameters. The range of jaw sizes that can be accommodated by any given set of power tongs is limited because the cage bolts interfere with the operation of the jaws. Moving these cage bolts and spacers out of the aperture would allow for a wider throat in open throat tongs, and would, with either type, accommodate a wider range of jaws, thus increasing the sizes of pipe that the tongs would service, and decreasing the need for a separate set of power tongs.

SUMMARY OF THE INVENTION

It is the object of the present invention to provide a power tong apparatus that can accommodate a wider range of pipe diameters than is possible with conventional power tongs.

It is a further object of the invention to provide a ring gear for such an apparatus that is slotted such that fasteners holding the top and bottom cage plates together pass through the slots instead of through the central aperture of the tongs inside the inner periphery of the ring gear where they interfere with the operation of the jaws.

The invention provides, in one aspect, a power tong apparatus for rotating a pipe. The apparatus comprises a tong housing defining a central housing aperture. A ring gear, having an inner periphery defining a central ring aperture and an outer periphery, is rotatably mounted in the tong housing such that an inner portion thereof extends into the central housing aperture such that the central ring aperture is inside the central housing aperture. A top cage plate is positioned above a top surface of the inner portion of the ring gear and a corresponding bottom cage plate is positioned below a bottom surface of the inner portion of the ring gear. The top and bottom cage plates define a central cage aperture oriented such that the central cage aperture is inside the central ring aperture. The top and bottom cage plates are fastened together to form a cage rotatable with respect to the tong housing and the ring gear. At least one jaw is pivotally attached to the cage and bears against the inner periphery of the ring gear and is operative to grip the pipe when the ring gear is rotated with respect to the cage, and a drive is operative to rotate the ring gear. The ring gear and cage rotate about a substantially vertical rotational axis located substantially in the center of the central cage aperture. The top and bottom cage plates are fastened together by a fastener extending through a slot in the ring gear located between the inner and outer peripheries of the ring gear, such that the cage plates can rotate with respect to the ring gear through a limited arc. The fastener is operative to maintain the cage plates in a fixed vertical relationship relative to each other.

The invention provides, in a second aspect, a power tong apparatus for rotating a pipe comprising a tong housing defining a central housing aperture and an open throat extending from an exterior of the tong housing to the central housing aperture. A ring gear has an inner periphery defining a central ring aperture, an outer periphery, and an open throat extending from the outer periphery to the inner periphery. The ring gear is rotatably mounted in the tong housing such that an inner portion thereof extends into the central housing aperture such that the central ring aperture is inside the central housing aperture. The ring gear further defines a pair of slots therethrough located on opposing sides of the central ring aperture. A top cage plate is positioned above a top surface of the inner portion of the ring gear and a corresponding bottom cage plate is positioned below a bottom surface of the inner portion of the ring gear. The top and bottom cage plates define a central cage aperture oriented such that the central cage aperture is inside the central ring aperture, and defines an open throat. The top and bottom cage plates are fastened together by a bolt and spacer extending through each slot in the ring gear to form a cage having an open throat extending from an exterior of the cage to the central cage aperture. The top and bottom cage plates are maintained in fixed relationship by the spacer, and the cage is rotatable with respect to the tong housing and the ring gear. At least one jaw is pivotally attached to the cage and bears against the inner periphery of the ring gear and is operative to grip the pipe when the ring gear is rotated with respect to the cage. A drive is operative to rotate the ring gear; and the ring gear and cage rotate about a substantially vertical rotational axis located substantially in the center of the central cage aperture.

The invention provides, in a third aspect, a ring gear adapted for rotatable mounting about a rotational axis in a power tong apparatus for rotating a pipe. The ring gear comprises an outer periphery adapted for engagement with a drive operative to rotate the ring gear and an inner periphery shaped to form at least one valley, and defines a central ring aperture. A slot is defined by the ring gear between the outer and inner peripheries. The slot is oriented to accommodate a bolt and spacer therethrough such that the bolt and spacer can secure a top cage plate, positioned above the ring gear, to a bottom cage plate positioned below the ring gear. The slot is further oriented to permit limited rotational movement of the ring gear with respect to the top and bottom cage plates.

Conventionally, the fastener attaching the top cage plate to the bottom cage plate passes through the central ring aperture inside the inner periphery of the ring gear. Removing this fastener from the conventional location frees essentially all the area of the central ring aperture inside the inner periphery of the ring gear for the jaw mechanism, allowing for larger pipes and jaws for the same diameter of ring gear.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
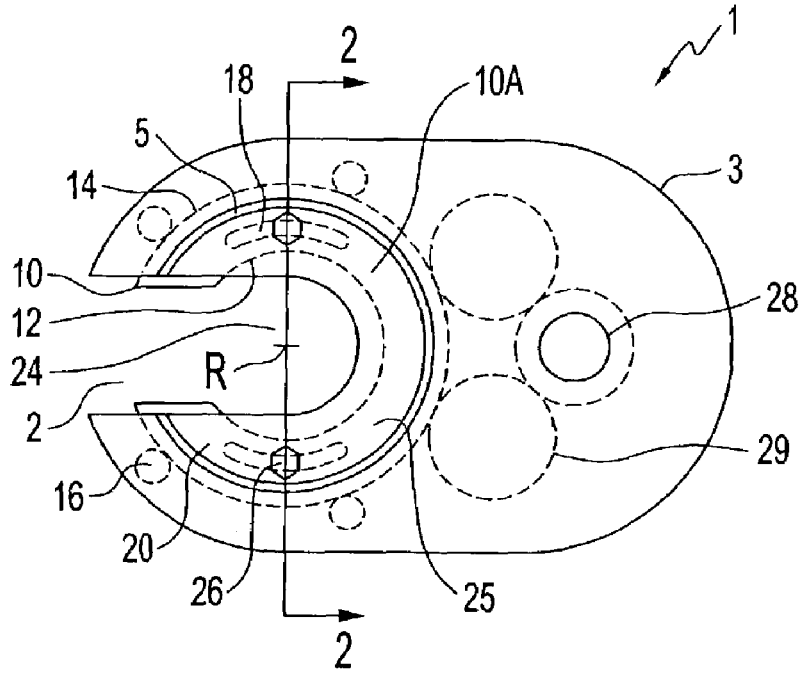
FIG. 1 is a schematic top view of an apparatus of the invention.
Figure 2:
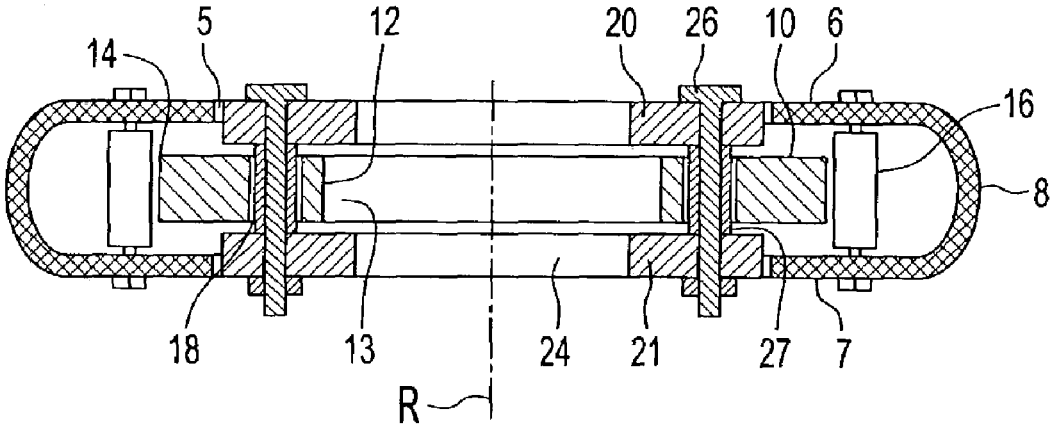
FIG. 2 is a schematic cross-sectional view of the apparatus of FIG. 1.

FIGS. 1 and 2 illustrate an open throat power tong apparatus 1 for rotating a pipe. A closed throat power tong apparatus will work in the same fashion, and is not further illustrated. The open throats can be aligned to provide an open passage 2 from an exterior of the apparatus 1 the interior thereof.

The apparatus 1 comprises a tong housing 3 defining a central housing aperture 5. The tong housing 3 includes top and bottom tong plates, 6, 7 and a sidewall 8.

A ring gear 10 has an inner periphery 12 defining a central ring aperture 13 and an outer periphery 14. The ring gear 10 is rotatably mounted in the tong housing 3 by a plurality of housing rollers 16 mounted in the tong housing 3 and bearing against the outer periphery 14 to maintain the ring gear 10 in its proper position, rotating about the substantially vertical rotation axis R. An inner portion 10A of the ring gear 10 extends into the central housing aperture 5 such that the central ring aperture 13 is inside the central housing aperture 15.

A top cage plate 20 is positioned above a top surface of the inner portion 10A of the ring gear 10 and a corresponding bottom cage plate 21 is positioned below a bottom surface of the inner portion 10A of the ring gear 10. The top and bottom cage plates 20, 21 are fastened together to form a cage 25 rotatable with respect to the tong housing 3 and the ring gear 10. In the illustrated embodiment the top cage plate 20 substantially fills the central housing aperture 5, and rotates on rollers (not illustrated) which run in a groove in the ring gear 10. In other configurations, the top cage plate 20 could extend over an inner portion of the top tong plate 6 and rotate on rollers attached to the tong plate. Various configurations are well known in the art.

The top and bottom cage plates 20, 21 define a central cage aperture 24 oriented such that the central cage aperture 24 is inside the central ring aperture 13. The cage 25 rotates about the rotation axis R, located in the center of the central cage aperture 24.

The top and bottom cage plates 20, 21 are fastened together by fasteners comprising a cage bolt 26 and spacer 27 extending through slots 18 in the ring gear 10 located between the inner and outer peripheries 12, 14 of the ring gear 10 and on opposing sides of the central ring aperture 24. Thus the cage 25 can rotate with respect to the ring gear 10 through a limited arc defined by the slots 18. The slots 18 are an arc-shape, the arc having a center located on the rotational axis R. The spacer 27 is operative to maintain the cage plates 20, 21 in a fixed vertical relationship relative to each other.

A drive motor 28 rotates drive gears 29 which mesh with teeth 11 on the outer periphery 14 of the ring gear 10 and cause same to rotate.

Figure 3:
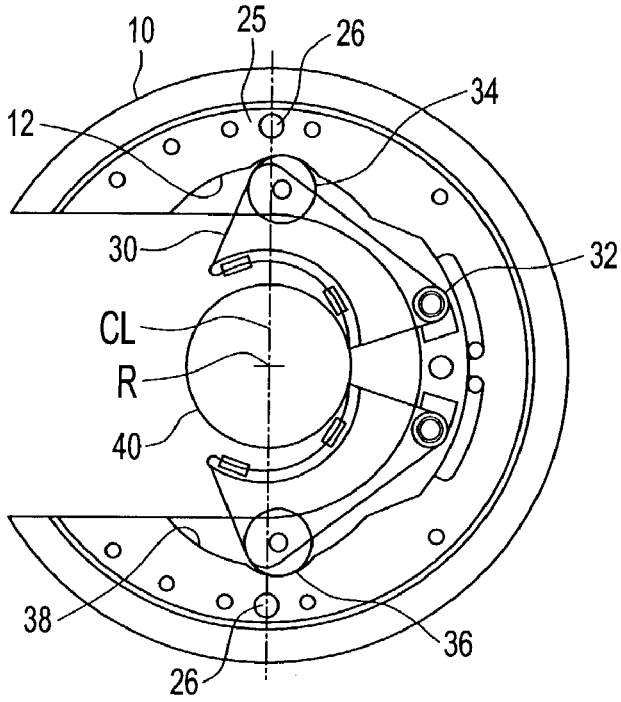
FIG. 3 is a schematic top view of the cage, jaws and ring gear with the jaws open to allow positioning on a pipe.
Figure 4:
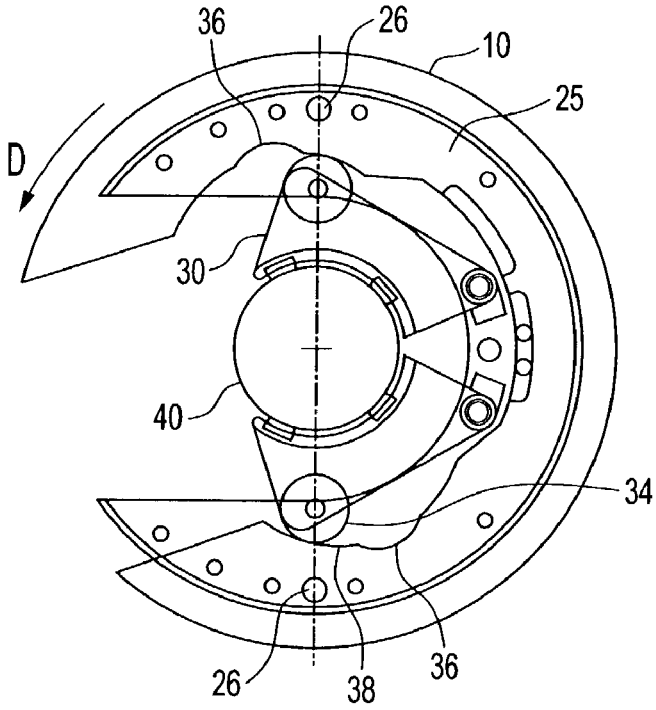
FIG. 4 is a schematic top view of the cage, jaws and ring gear with the jaws closed on a pipe.

FIGS. 3 and 4 schematically illustrate the operation of a pair of jaws 30. The slots 18 in the ring gear 10 are omitted for clarity of illustration, but the location of the cage bolts 26 is indicated. Each jaw 30 is pivotally attached to the cage 25 at pivot pins 32. A jaw roller 34 bears against the inner periphery 12 of the ring gear 10. The inner periphery 12 of the ring gear 10 defines a pair of valleys 36 located on opposing faces of the inner periphery 12. The valleys 36 have centers removed from a centerline CL of the cage aperture 24 in a direction opposite the open throat of the ring gear 10. This configuration is preferred in order to properly align the jaws 30 and pipe 40.

In FIG. 3, the jaw rollers 34 are located in the bottom of the valleys 36 and the jaw mechanism is open such that the apparatus 1 can be moved into position on a pipe 40. Conventionally, rotation of the cage 25 is retarded by a brake (not shown) such that when the drive motor 28 starts to rotate the ring gear 10 in direction D, the cage 25 stands still and in effect rotates with respect to the ring gear 10. The jaw rollers 34 move out of the bottoms and up the slopes 38 of the valleys 36 thereby moving the jaws 30 into engagement with the pipe 40 as illustrated in FIG. 4. The mechanism essentially binds against the pipe and then the ring gear 10, cage 25, jaws 30, and pipe 40 all rotate together. Reversing rotation of the ring gear first releases the jaws 30 and then re-engages them to rotate the pipe 40 in the opposite direction.

The top and bottom cage plates 20, 21 are firmly held in place relative to each other by the cage bolts 26 and the pivot pins 32.

FIGS. 3 and 4 show that removal of the cage bolts from the conventional location inside the central ring aperture 13 allows essentially all the area inside the inner periphery 12 of the ring gear 10 to be occupied by the pipe 40, and by the jaws 30 and jaw rollers 34 as they move along the inner periphery of the ring gear 10.

Figure 5:
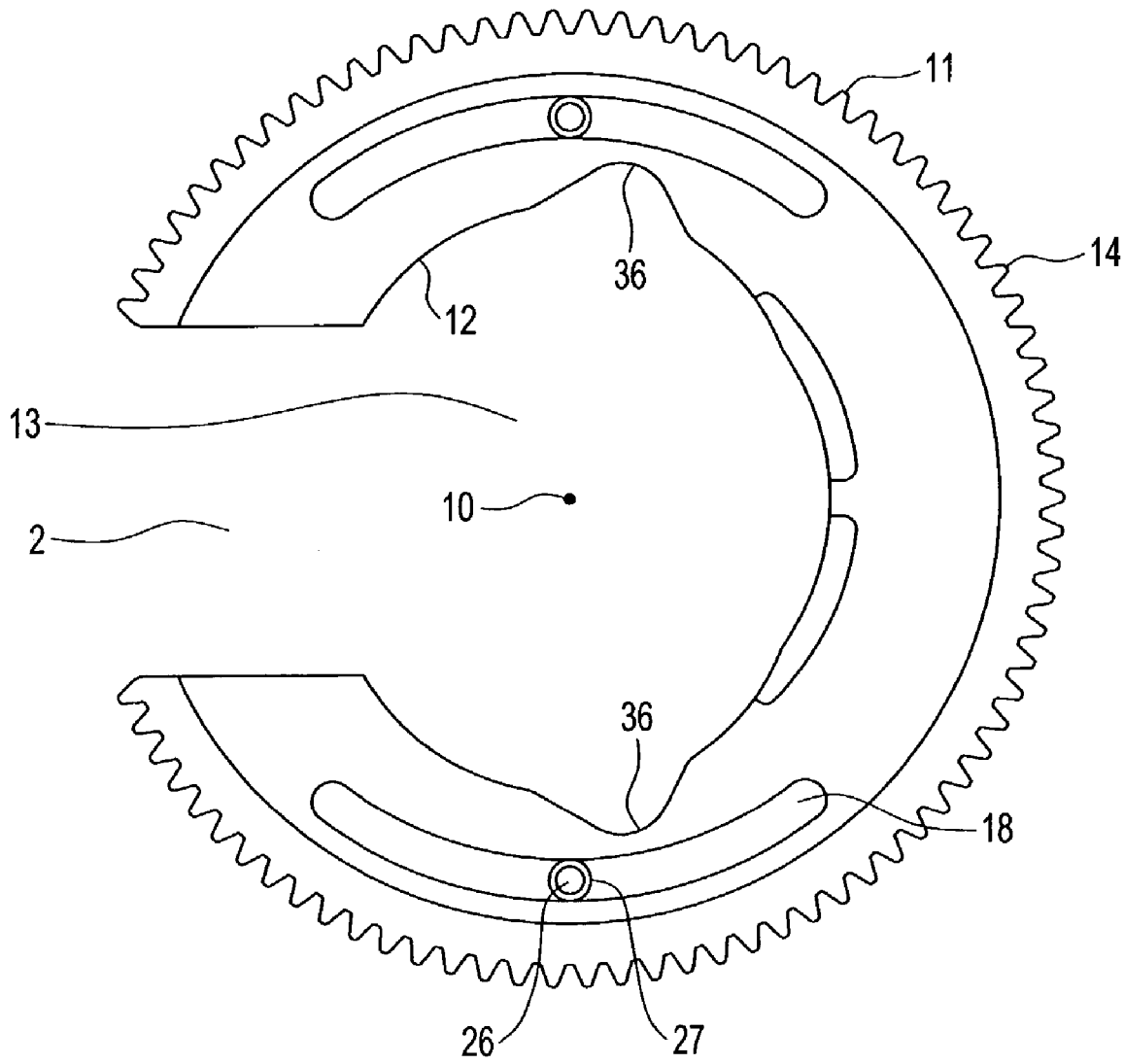
FIG. 5 is a schematic top view of a ring gear of the invention showing the location of cage bolts and spacers for attaching top and bottom cage plates.

FIG. 5 illustrates a typical ring gear 10 of the invention, adapted for rotatable mounting about a rotational axis R in a power tong apparatus 1 for rotating a pipe 40. The outer periphery 14 is adapted for engagement by meshing gear teeth 11 with a drive operative to rotate the ring gear 10. The inner periphery 12 is shaped to form valleys 36, and defining a central ring aperture 13. Slots 18 are defined by the ring gear 10 between the outer and inner peripheries 12, 14 on opposing sides of the central ring aperture 13. The slots 18 are oriented to accommodate a cage bolt 26 and spacer 27 therethrough such that the cage bolt 26 and spacer 27 can secure a top cage plate 20, positioned above the ring gear 10, to a bottom cage plate 21 positioned below the ring gear 10. The slots 18 permit limited rotational movement of the ring gear 10 with respect to the top and bottom cage plates 20, 21.

The slots 18 as illustrated have an arc-shape, the arc having a center located on the rotational axis R. This configuration requires a minimum width slot 18, the same width as the spacer 27. The cage bolt and spacer 26, 27 rotate around the rotational axis R and follow the slot 18.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

I claim:

1. A power tong apparatus for rotating a pipe, the apparatus comprising:

a tong housing defining a central housing aperture;

a ring gear, having an outer periphery, and having an inner periphery defining a central ring aperture, the ring gear rotatably mounted in the tong housing such that an inner portion thereof extends into the central housing aperture such that the central ring aperture is inside the central housing aperture;

a top cage plate positioned above a top surface of the inner portion of the ring gear and a corresponding bottom cage plate positioned below a bottom surface of the inner portion of the ring gear, the top and bottom cage plates defining a central cage aperture oriented such that the central cage aperture is inside the central ring aperture, the top and bottom cage plates fastened together to form a cage rotatable with respect to the tong housing and the ring gear;

at least one jaw pivotally attached to the cage and bearing against the inner periphery of the ring gear and operative to grip the pipe when the ring gear is rotated with respect to the cage; and a drive operative to rotate the ring gear;

wherein the ring gear and cage rotate about a substantially vertical rotational axis located substantially in the center of the central cage aperture; and wherein the top and bottom cage plates are fastened together by a fastener extending through a slot in the ring gear located between the inner and outer peripheries of the ring gear, such that the cage plates can rotate with respect to the ring gear through a limited arc, the fastener operative to maintain the cage plates in a fixed vertical relationship relative to each other.

2. The apparatus of claim 1 wherein the fastener comprises a bolt extending through the slot, and a spacer between the top and bottom cage plates.

3. The apparatus of claim 2 wherein the bolt extends through the spacer, and the bolt and spacer extend through the slot.

4. The apparatus of claim 1 wherein the slot is an arc-shape, the arc having a center located on the rotational axis.

5. The apparatus of claim 1 wherein the inner periphery of the ring gear defines a pair of valleys located on opposing faces of the inner periphery, the valleys having centers removed from a centerline of the cage aperture in a direction opposite the open throat of the ring gear.

6. The apparatus of claim 1 wherein the tong housing, ring gear and cage each define an open throat, and wherein the open throats can be aligned to provide an open passage from an exterior of the apparatus to the central cage aperture.

7. A power tong apparatus for rotating a pipe comprising:

a tong housing defining a central housing aperture and an open throat extending from an exterior of the tong housing to the central housing aperture;

a ring gear, having an inner periphery defining a central ring aperture, an outer periphery, an open throat extending from the outer periphery to the inner periphery, the ring gear rotatably mounted in the tong housing such that an inner portion thereof extends into the central housing aperture such that the central ring aperture is inside the central housing aperture, the ring gear further defining a pair of slots therethrough located on opposing sides of the central ring aperture;

a top cage plate positioned above a top surface of the inner portion of the ring gear and a corresponding bottom cage plate positioned below a bottom surface of the inner portion of the ring gear, the top and bottom cage plates defining a central cage aperture oriented such that the central cage aperture is inside the central ring aperture, and defining an open throat;

wherein the top and bottom cage plates are fastened together by a bolt and spacer extending through each slot in the ring gear to form a cage having an open throat extending from an exterior of the cage to the central cage aperture, the top and bottom cage plates maintained in fixed relationship by the spacer, the cage rotatable with respect to the tong housing and the ring gear;

at least one jaw pivotally attached to the cage and bearing against the inner periphery of the ring gear and operative to grip the pipe when the ring gear is rotated with respect to the cage; and a drive operative to rotate the ring gear;

wherein the ring gear and cage rotate about a substantially vertical rotational axis located substantially in the center of the central cage aperture.

8. The apparatus of claim 7 wherein the slot is an arc-shape, the arc having a center located on the rotational axis.

9. The apparatus of claim 7 wherein the inner periphery of the ring gear defines a pair of valleys located on opposing faces of the inner periphery, the valleys having centers removed from a centerline of the cage aperture in a direction opposite the open throat of the ring gear.

10. A ring gear adapted for rotatable mounting about a rotational axis in a power tong apparatus for rotating a pipe, the ring gear comprising:

an outer periphery adapted for engagement with a drive operative to rotate the ring gear;

an inner periphery shaped to form at least one valley, and defining a central ring aperture;

a slot defined by the ring gear between the outer and inner peripheries, the slot oriented to accommodate a bolt and spacer therethrough such that the bolt and spacer can secure a top cage plate, positioned above the ring gear, to a bottom cage plate positioned below the ring gear, the slot further oriented to permit limited rotational movement of the ring gear with respect to the top and bottom cage plates.

11. The ring gear of claim 10 wherein the slot is an arc-shape, the arc having a center located on the rotational axis.

12. The ring gear of claim 10 wherein the ring gear defines a pair of slots therethrough located on opposing sides of the central ring aperture, each slot oriented to accommodate a bolt and spacer therethrough such that the bolt and spacer can secure the top cage plate to the bottom cage plate, the slots further oriented to permit limited rotational movement of the ring gear with respect to the top and bottom cage plates.

13. The ring gear of claim 10 wherein the outer periphery of the ring gear is adapted for engagement with a drive operative to rotate the ring gear by providing gear teeth on the outer periphery.

14. The ring gear of claim 10 wherein the ring gear defines an open throat extending from the outer periphery to the inner periphery thereof.

* * * * *